US008061179B2

(12) United States Patent
Jensen et al.

(10) Patent No.: US 8,061,179 B2
(45) Date of Patent: Nov. 22, 2011

(54) HIGH PRESSURE DUAL-ACTION HYDRAULIC PUMP

(75) Inventors: David R. Jensen, Swartz Creek, MI (US); Mike M. Ghiran, Lake Orion, MI (US); Ranny Joe Nunley, Metamora, MI (US); David R. Friddell, Grand Blanc, MI (US); William M. Crantas, Highland, MI (US); Kevin R. Marks, Durand, MI (US); Paul D. Larsen, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 756 days.

(21) Appl. No.: 12/189,871

(22) Filed: Aug. 12, 2008

(65) Prior Publication Data

US 2010/0040485 A1 Feb. 18, 2010

(51) Int. Cl.
*F04B 23/10* (2006.01)
*B21D 26/02* (2006.01)

(52) U.S. Cl. ..... 72/453.02; 72/453.08; 72/56; 72/60; 100/269.06; 100/269.08

(58) Field of Classification Search ..... 72/441, 72/453.01, 453.02, 453.08, 453.18; 100/269 B
See application file for complete search history.

(56) References Cited

U.S. PATENT DOCUMENTS

| | | | | |
|---|---|---|---|---|
| 3,180,129 | A * | 4/1965 | Riemenschneider et al. | 72/453.1 |
| 3,707,866 | A * | 1/1973 | Brauer | 72/407 |
| 4,152,921 | A * | 5/1979 | Dits | 72/441 |
| 2010/0072678 | A1 | 3/2010 | Augustin | |

FOREIGN PATENT DOCUMENTS

| | | | |
|---|---|---|---|
| DE | 8808802 | U1 | 9/1988 |
| DE | 29611173 | U1 | 8/1996 |
| DE | 102006048290 | A1 | 4/2008 |

* cited by examiner

*Primary Examiner* — David Jones
(74) *Attorney, Agent, or Firm* — Quinn Law Group, PLLC

(57) ABSTRACT

A high pressure pump includes a pump housing. A piston rod located within the pump housing defines a plurality of pump cavities and a plurality of piston cavities. Movement of the piston within the piston cylinder pumps the fluid from the piston cavities out of the high pressure pump. The continuous pumping of HWBF from the pump housing provides fluid at a relatively constant flow and pressure. The HWBF pressure is also at a higher pressure than traditional single stage high pressure pumps can provide.

16 Claims, 3 Drawing Sheets

HIGH PRESSURE DUAL-ACTION HYDRAULIC PUMP

TECHNICAL FIELD

The present invention relates generally to hydroform dies, and more specifically to a high pressure pump for use in a hydroforming process.

BACKGROUND OF THE INVENTION

Hydroforming dies are used to form a cross-sectional profile in tubular parts. Commonly, a tubular part is placed within a die cavity. The die cavity is then filled with a Hydroforming Water-Based Fluid (HWBF) and pressurized to expand the tubular part outward against the die into the desired cross-sectional profile.

High pressure pumps are typically used when HWBF pressures are required in a hydroforming process. The flow rate of fluid from the high pressure pump is limited by the capacity of the pump providing the fluid. Typical single stage hydraulic pumps cannot provide variable displacement at pressures commonly required for hydroforming processes. Single stage pumps are limited to adding fluid in only one stroke direction of the pump. Therefore, fluid flow from the high pressure pump is not constant.

To provide the required amount of fluid at the required pressure may take a significant period of time, slowing the manufacturing process. To provide larger amounts of the high pressure fluid, larger pumps can be used. However, as the size of the pump providing high pressure fluid is increased so does the cost of the pump.

SUMMARY OF THE INVENTION

A pump that can continuously provide fluid for a hydroforming process at a high fluid pressure is provided.

A high pressure pump of the present invention has a pump housing. A piston-rod assembly is located within a piston cylinder defined by the pump housing. A first piston is located at a first end of the piston-rod assembly and a second piston is located at a second end of the piston-rod assembly. A first pump cavity and a second pump cavity are located at the first end and divided by the first piston. A third pump cavity and a fourth pump cavity are located at the second end and divided by the second piston. A center piston is mounted on the piston-rod assembly between the first end and the second end. The center piston divides the piston cylinder into a first piston cavity and a second piston cavity.

A first fluid inlet path is flowingly connected to the first piston cavity and a second fluid inlet path is flowingly connected to the second piston cavity to provide fluid in the piston cavities. Movement of the center piston within the piston cylinder pumps the fluid from the first piston cavity out a first fluid outlet path or fluid from the second piston cavity out a second fluid outlet path. Fluid exits the high pressure pump through the fluid outlets.

Alternately filling and draining the pump cavities results in the piston-rod assembly reciprocating between first and second ends of travel. As a result of the movement, the center piston pushes the HWBF within the piston cavities out through the fluid outlets. Check valves located within the fluid inlet paths and the fluid outlet paths prevent fluid from flowing back as a result of fluid pressure.

The reciprocating action of the piston-rod assembly provides a continuous flow of HWBF from the pump housing. Thus, providing fluid at a relatively constant flow and pressure for the amount of time required. In addition to providing a continuous flow of HWBF for a longer period of time the HWBF pressure exiting the high pressure pump is also at a higher pressure than traditional high pressure pumps can provide and allows for variable displacement at the desired pressure.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENT

Figure 1:
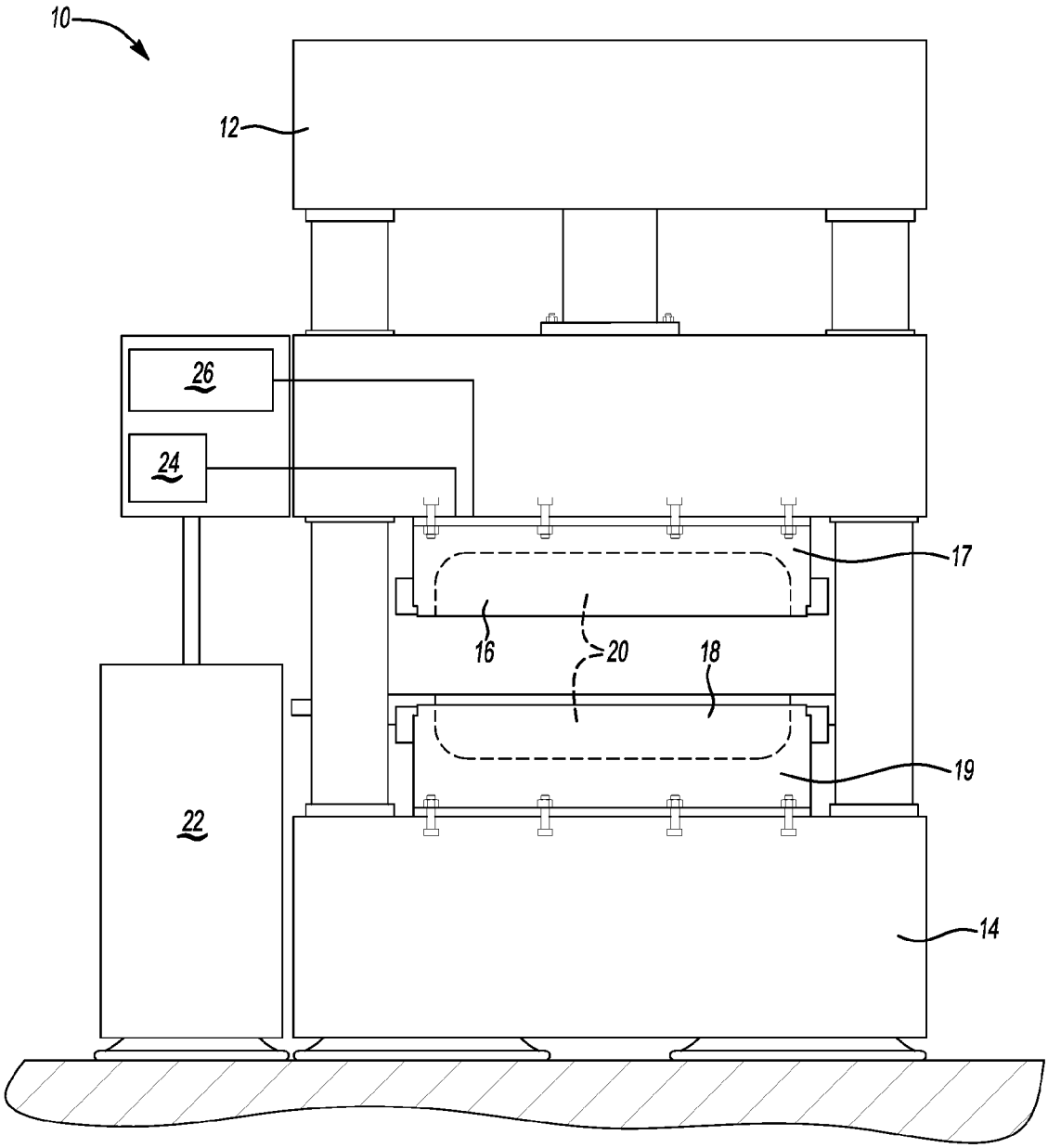
FIG. 1 is a schematic view illustrating a press including a hydroforming die.

Referring to the Figures, wherein like reference numbers refer to the same or similar components throughout the several views, FIG. 1 is a schematic view of an exemplary press 10.

The press 10 includes a press crown 12 and a press bed 14. A hydroforming die, located in the press 10, includes an upper die housing 17 mounted to the press crown 12 and a lower die housing 19 mounted to the press bed 14. At least one upper die cavity portion 16 is defined by the upper die housing 17 and at least one lower die cavity portion 18 is defined by the lower die housing 19. When the press 10 is closed, the upper die cavity portion 16 and the lower die cavity portion 18 together form a die cavity 20 which has a cross-section equivalent to the cross-section of the component to be formed by the press 10.

A HWBF fluid supply tank 22 is operatively connected to the die cavity 20 to provide fluid for filling the die cavity 20 and forming the component. A low pressure pump 24 pumps fluid into the die cavity 20 from the supply tank 22. The low pressure pump 24 provides fluid to the die cavity 20 at a high fluid rate to quickly fill the die cavity 20. In addition, a high pressure pump 26 provides fluid to the die cavity 20 at a higher pressure than the low pressure pump 24. Alternately, the low pressure pump 24 may be eliminated and the high pressure pump 26 may be used to provide the fluid for filling the die cavity 20 as well as providing the high pressure fluid.

Figure 2:
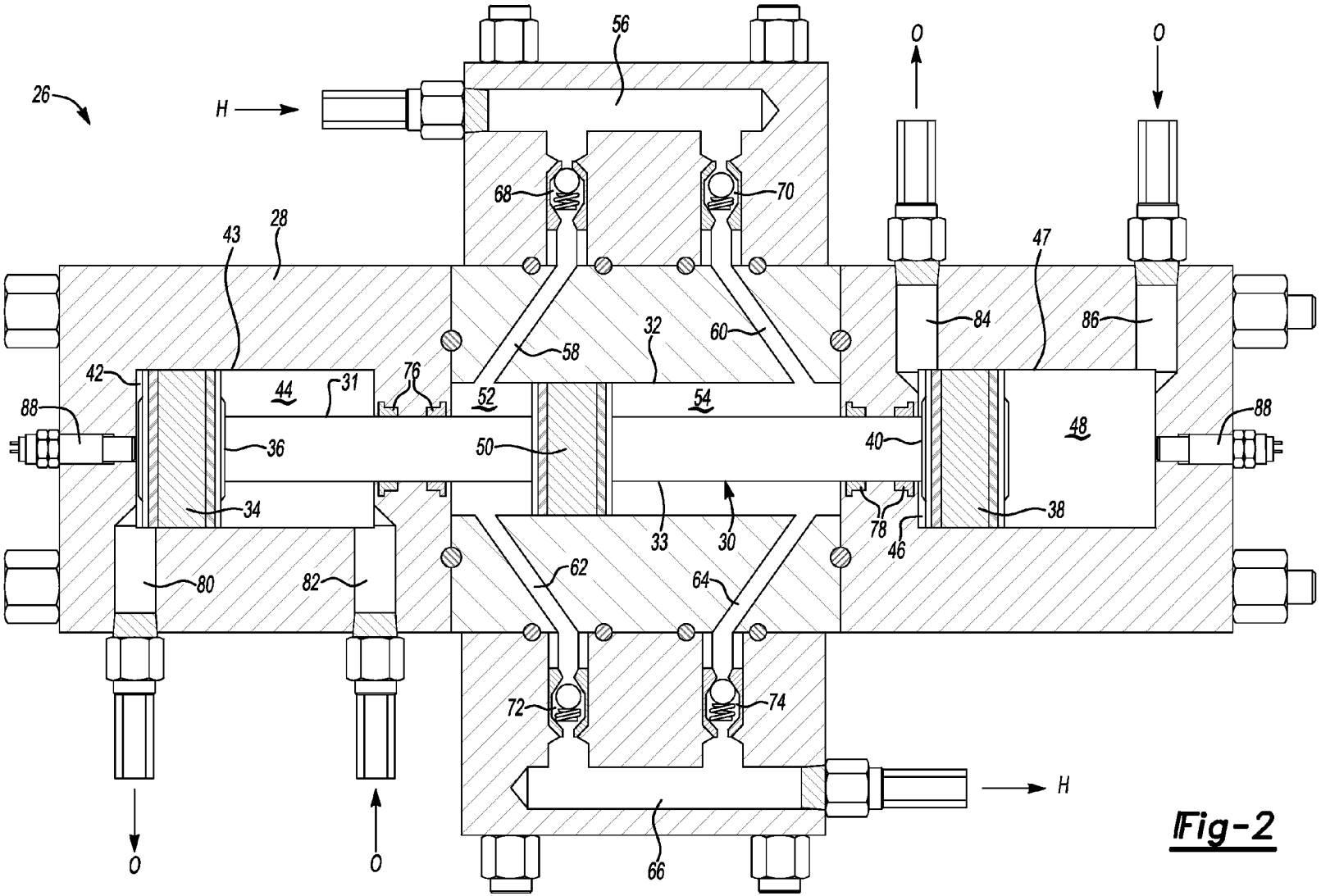
FIG. 2 is a cross-sectional view of a high pressure hydraulic pump in a first position for use with the hydroforming die of FIG. 1.

FIG. 2 illustrates a cross-sectional view of the high pressure pump 26 in a first position. The high pressure pump 26 has a pump housing 28. The pump housing 28 may be formed as a single piece or of several components that are fastened together and fluidly sealed, as shown.

A piston rod assembly 30 is at least partially located within a piston cavity 32 defined by the pump housing 28. The piston cavity 32 can be a multi-segmented cavity and is not necessarily cylindrical in overall shape.

A center piston 50 is connected to a first piston 34 by a first piston rod 31. The center piston 50 is also connected to a second piston 38 by a second piston rod 33. The first and second pistons 34 and 38 are of identical diameter. The first and second piston rods 30 and 31 are of identical size and length. The center piston 50 will typically be smaller in diameter than the first and second pistons 34 and 38. The first piston 34 is located in a first cavity 43 defined by the pump housing 28. The second piston 38 is located in a second cavity 47 also defined by the pump housing 28. Fluid in the first cavity 43 is isolated from the piston cavity 32 by at least one first seal 76. Additionally, fluid in the second cavity 47 is isolated from the piston cavity 32 by at least one second seal 78. The first piston 34, the second piston 38, the center piston 50, the first piston rod 31 and the second piston rod 33 form the piston-rod assembly 30 which moves with a laterally reciprocating motion.

The first cavity 43 is fluidly separated into a first pump cavity 42 and a second pump cavity 44 by the first piston 34. The second cavity 47 is fluidly separated into a first pump cavity 46 and a fourth pump cavity 48 by the second piston 38. Additionally, the piston cavity 32 is fluidly separated into a first piston cavity 52 and a second piston cavity 54 by the center piston 50.

A fluid inlet 56 allows hydroforming fluid to enter the pump housing 28. The fluid is preferably Hydroforming Water Based Fluid (HWBF), as shown. A first fluid inlet path 58 is flowingly connected to the first piston cavity 52 from the fluid inlet 56. Likewise a second fluid inlet path 60 is flowingly connected to the second piston cavity 54 from the fluid inlet 56. Movement of the center piston 50 within the piston cylinder 32 pumps the fluid from the first piston cavity 52 out a first fluid outlet 62 or fluid from the second piston cavity 54 out a second fluid outlet 64. The first fluid outlet path 62 and the second fluid outlet path 64 combine into a fluid outlet 66. Fluid, exits the high pressure pump 26 through the fluid outlet 66 and enters the die cavity 20 (shown in FIG. 1) to form the component (not shown) located therein. A first inlet check valve 68 and a second inlet check valve 70 are located within the first fluid inlet path 58 and the second fluid inlet path 60, respectively, to prevent fluid from flowing back through the fluid inlet 56, as a result of fluid pressure with the first piston cavity 52 and the second piston cavity 54. Likewise, a first outlet check valve 72 and a second outlet check valve 74 prevent fluid in the fluid outlet 66 and die cavity 20 from flowing back into the first piston cavity 52 and the second piston cavity 54.

The first pump cavity 42 is fluidly sealed from the second pump cavity 44 by the first piston 34. The second pump cavity 44 is fluidly sealed from the first piston cavity 52 with at least one first seal 76. Likewise, the fourth pump cavity is fluidly sealed from the third pump cavity 46 by the second piston 38. The third pump cavity 46 is also fluidly sealed from the second piston cavity 54 with at least one second seal 78. In the embodiment shown, there are two first seals 76 and two second seals 78. The second pump cavity 44 and the fourth pump cavity 48 are filled with a fluid, preferably oil. A first oil passage 80 allows oil to enter and leave the first pump cavity 42. A second oil passage 82 allows oil to enter and leave the second pump cavity 44. A third oil passage 84 allows oil to enter and leave the third pump cavity 46. A fourth oil passage 86 allows oil to enter and leave the fourth pump cavity 48. Oil entering through the first oil passage 80, the second oil passage 82, the third oil passage 84 and the fourth oil passage 86 may be provided by a common source (not shown). Likewise, oil exiting through the first, second, third and fourth oil passages 80, 82, 84 and 86 may return to the same common source.

The center piston 50 is in a first position in FIG. 2. The second pump cavity 44 has been filled with oil through the second oil passage 82. Oil within the first pump cavity 42, on the opposing side of the first piston 34, has exited through the first oil passage 80. Likewise, the fourth pump cavity 48 has been filled with oil through the fourth oil passage 86. Oil within the third pump cavity 46, on the opposing side of the second piston 38, has exited through the third oil passage 84. Filling the second pump cavity 44 through the second oil passage 82 and the fourth pump cavity 48 through the fourth oil passage 86 has caused the center piston 50 to move toward an end of the cylinder 32 (toward the left as depicted in FIG. 2) to the full extent of the travel desired (i.e. the first position of FIG. 2 shows the center piston 50 at a first end of travel). As a result of the movement, the center piston 50 has pushed the HWBF within the first piston cavity 52 out through the first fluid outlet path 62. The first inlet check valve 68 prevents the HWBF from exiting through the first fluid inlet path 58 during this time. On the opposing side of the center piston 50, HWBF is filling the second piston cavity 54 through the second fluid inlet path 60. The second outlet check valve 74 prevents HWBF from exiting the second piston cavity 54 through the second fluid outlet path 64 during this time. The second outlet check valve 74 is closed as a result of the HWBF pressure within fluid outlet 66 resulting from HWBF exiting through the first fluid outlet path 62.

Figure 3:
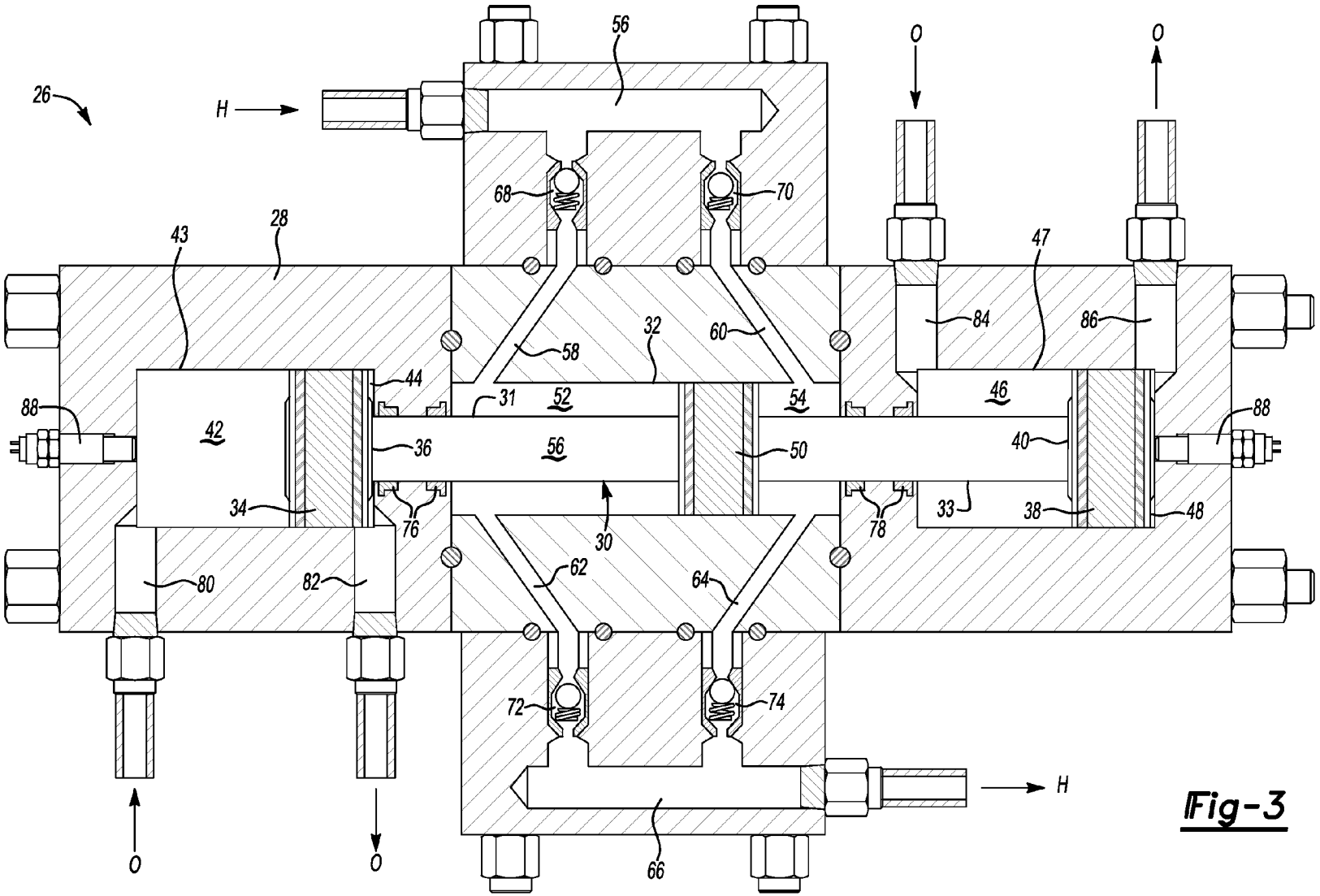
FIG. 3 is a cross-sectional view of the high pressure hydraulic pump of FIG. 2 in a second position.

FIG. 3 illustrates the center piston 50 in a second position. Oil has exited the second pump cavity 44 through the second oil passage 82 and has exited the fourth pump cavity 48 through the fourth oil passage 86. In other words, the oil flow within the second oil passage 82 and the fourth oil passage 86 has changed direction. At the same time, oil flow has changed direction in the first oil passage 80 and the third oil passage 84 to fill the first pump cavity 42 and the third pump cavity 46. Movement of the center piston 50 toward an opposing end of the piston cylinder 32 (toward the right as depicted in FIG. 3), to a second end of travel desired (i.e. the second position of FIG. 3 shows the center piston 50 at a second end of travel), has caused HWBF to exit the second piston chamber 54 through the second fluid outlet path 64. The first outlet check valve 72 has closed and the second outlet check valve 74 has opened as a result of the change in the HWBF pressure. In addition, the first inlet check valve 68 has opened to fill the first piston chamber 52 with HWBF. The second inlet check valve 70 has closed to prevent HWBF in the second piston chamber 54 from exiting through the second fluid inlet 60.

Reciprocating the center piston 50 back and forth between the first end of travel and the second end of travel of the piston cylinder 32 provides HWBF to the die cavity 20 at a relatively constant flow and pressure. The first end of travel and the second end of travel may be less than the available full travel of the center piston 50. Stopping the reciprocation of the center piston 50 prior to full travel will prevent the first piston 34 and the second piston 38 from contacting the pump housing 28. Sensors 88 are located in the pump housing 28. The sensors 88 may provide information on the location of the center piston 50 during high pressure pump 26 operation. In the embodiment shown, the sensors 88 are proximity switches. The sensors 88 may also be linear transducers or the like. One skilled in the art would know the appropriate sensor 88 for use with the high pressure pump 26. In addition to preventing contact with the pump housing 28 changing the direction of the center piston 50 prior to the end of travel may help to reduce variations in pressure of the fluid exiting the high pressure pump 26 through the fluid outlet 66.

The oil pressure in the filling chamber, the first pump cavity 42 and the third pump cavity 46 in FIG. 3, would typically be approximately 3000 psi. While the HWBF exiting the high pressure pump 26 through the outlet passage 66 into the die cavity 20 would typically be approximately 11,000 psi. The oil and HWBF pressures can be varied as required by the process. The pressure of the fluid in the outlet passage 66 is a function of the size ratio between effective surface area of the first and second cylinder heads 34 and 38 and effective surface area of the center piston 50. FIG. 2 shows the center piston 50 ready to move to the right. The force on the center piston 50 will be the sum of each force from the first piston 34 and the second piston 38. As the first and second pistons 34 and 38 shift right, the force from the first piston 34 will be the product of oil pressure in the first oil passage 80 times the cross-sectional area of the first piston 34. The force from the second piston 38 will be the product of oil pressure in the third oil passage 84 times the cross sectional area of the second piston 38, less the cross sectional area of the second piston rod 33. Varying the ratio of piston and rod sizes will vary the oil and HWBF pressures, respectively. Varying the piston stroke length or time of pumping will vary the displacement of fluid into the die cavity 20. Multiple high pressure pumps 26 may be arranged in a series to further increase an outlet fluid pressure. One skilled in the art would know the desired pressure, displacement and required adjustments therefore.

The high pressure pump 26 of the above embodiment has been described for use in a hydroforming process. The high pressure pump 26 may also be used in other manufacturing processes which require fluid at a high pressure.

While the best mode for carrying out the invention have been described in detail, those familiar with the art to which this invention relates will recognize various alternative designs and embodiments for practicing the invention within the scope of the appended claims.

The invention claimed is:

1. A high pressure pump comprising:

a pump housing defining a cylinder, a fluid inlet and a fluid outlet;

a moveable piston located within the cylinder;

a plurality of heads mounted on the piston to divide the cylinder into a plurality of cavities; and wherein at least two of the cavities are each fluidly connected with the fluid inlet and the fluid outlet.

2. The high pressure pump of claim 1, wherein the plurality of heads comprises a first piston partially defining a first pump cavity and a second pump cavity of the plurality of cavities, a second piston partially defining a third pump cavity and a fourth pump cavity of the plurality of cavities, and a center piston located between the first piston and the second piston, wherein the center piston partially defines a first piston cavity and a second piston cavity of the plurality of cavities.

3. The high pressure pump of claim 2, wherein the first, second, third and fourth pump cavities are selectively filled with oil and wherein the first and second piston cavities are selectively filled with HWBF.

4. The high pressure pump of claim 3, wherein the pump housing defines a first oil passage fluidly connected to the first pump cavity, a second oil passage fluidly connected to the second pump cavity, a third oil passage fluidly connected to the third pump cavity and a fourth oil passage fluidly connected to the fourth pump cavity.

5. The high pressure pump of claim 2, wherein the pump housing defines a first fluid inlet path and a first fluid outlet path fluidly connecting the fluid inlet and the fluid outlet, respectively, to the first piston cavity, and wherein the pump housing defines a second fluid inlet path and a second fluid outlet path fluidly connecting the fluid inlet and the fluid outlet, respectively, to the second piston cavity.

6. The high pressure pump of claim 5, wherein a first inlet check valve is located in the first fluid inlet path, a second inlet check valve is located in the second fluid inlet path, wherein the first fluid inlet check valve and the second fluid inlet check valve prevent fluid from exiting the first and the second piston cavity through the first fluid inlet path and the second fluid inlet path, and a first outlet check valve and a second outlet check valve are located in the first fluid outlet path and the second fluid outlet path to prevent fluid exiting from returning to the first piston cavity and the second piston cavity.

7. The high pressure pump of claim 5, wherein HWBF flows through the first fluid outlet path from the first piston cavity when the piston is located at a first end of travel and the second pump cavity and the fourth pump cavity are filled with oil, and wherein HWBF flows through the second fluid outlet path from the second piston cavity when the piston is located at a second end of travel and the first pump cavity and the third pump cavity are filled with oil.

8. The high pressure pump of claim 1, wherein fluid exiting through the fluid outlet is at a substantially constant pressure.

9. A hydroform die comprising:

an upper die housing and a lower die housing defining a die cavity located therebetween;

a high pressure pump including a pump housing defining a cylinder, a fluid inlet and a fluid outlet;

a movable piston located within the cylinder;

a plurality of heads mounted on the piston to divide the cylinder into a plurality of cavities; and a first fluid selectively filling at least two of the cavities;

wherein the at least two of the cavities are fluidly connected with the fluid inlet and the fluid outlet; and wherein the fluid outlet is fluidly connected to the die cavity.

10. The hydroform die of claim 9, wherein the plurality of heads comprises a first piston partially defining a first pump cavity and a second pump cavity of the plurality of cavities, a second piston partially defining a third pump cavity and a fourth pump cavity of the plurality of cavities, and a center piston located between the first piston and the second piston, wherein the center piston partially defines a first piston cavity and a second piston cavity of the plurality of cavities.

11. The hydroform die of claim 10, wherein the first, second, third and fourth pump cavities are selectively filled with oil and wherein the first and second piston cavities are selectively filled with HWBF.

12. The hydroform die of claim 10, wherein the pump housing defines a first oil passage fluidly connected to the first pump cavity, a second oil passage fluidly connected to the second pump cavity, a third oil passage fluidly connected to the third pump cavity and a fourth oil passage fluidly connected to the fourth pump cavity.

13. The hydroform die of claim 10, wherein the pump housing defines a first fluid inlet path and a first fluid outlet path fluidly connecting the fluid inlet and the fluid outlet, respectively, to the first piston cavity, and wherein the pump housing defines a second fluid inlet path and a second fluid outlet path fluidly connecting the fluid inlet and the fluid outlet, respectively, to the second piston cavity.

14. The hydroform die of claim 13, wherein a first inlet check valve is located in the first fluid inlet path, a second inlet check valve is located in the second fluid inlet path, wherein the first fluid inlet check valve and the second fluid inlet check valve prevent fluid from exiting the first and the second piston cavity through the first fluid inlet path and the second fluid inlet path, and a first outlet check valve and a second outlet check valve are located in the first fluid outlet path and the second fluid outlet path to prevent fluid exiting from returning to the first piston cavity and the second piston cavity.

15. The hydroform die of claim 13, wherein HWBF flows through the first fluid outlet path from the first piston cavity when the piston is located at a first end of travel and the second pump cavity and the fourth pump cavity are filled with oil, and wherein HWBF flows through the second fluid outlet path from the second piston cavity when the piston is located at a second end of travel and the first pump cavity and the third pump cavity are filled with oil.

16. The hydroform die of claim 9, wherein fluid exiting through the fluid outlet is at a constant pressure.

* * * * *